US006443334B1

(12) United States Patent
John et al.

(10) Patent No.: US 6,443,334 B1
(45) Date of Patent: Sep. 3, 2002

(54) COMESTIBLE FLUID DISPENSER APPARATUS AND METHOD

(75) Inventors: Chun Kuen Sham John, Hong Kong (HK); Kumkit Kunavongvorakul, Thailand (TH)

(73) Assignee: Pentalpha Hong Kong Limited, Hong Kong (HK)

( * ) Notice: Subject to any disclaimer, the term of this patent is extended or adjusted under 35 U.S.C. 154(b) by 0 days.

(21) Appl. No.: 09/832,333

(22) Filed: Apr. 10, 2001

(51) Int. Cl.[7] ..... B67D 5/60

(52) U.S. Cl. ..... 222/464.3; 222/146.6; 222/333; 222/382; 222/383.1

(58) Field of Search ..... 222/146.6, 333, 222/382, 383.1, 383.2, 464.3, 51, 1

(56) References Cited

U.S. PATENT DOCUMENTS

| | | | | |
|---|---|---|---|---|
| 1,586,745 | A | 6/1926 | Hulse | |
| 2,063,171 | A | 12/1936 | Kucher | |
| 2,105,990 | A | 1/1938 | Schultz et al. | |
| 2,212,749 | A | 8/1940 | Pelouch | |
| 2,786,338 | A | 3/1957 | Wurtz et al. | |
| 2,871,675 | A | 2/1959 | Cornelius | |
| 3,269,143 | A | 8/1966 | Gasparovich | |
| 3,698,454 | A | 10/1972 | Cunha et al. | |
| 4,061,184 | A | 12/1977 | Radcliffe | |
| 4,081,134 | A * | 3/1978 | Anderson | 239/30 |
| 4,699,188 | A | 10/1987 | Baker et al. | |
| 4,723,688 | A | 2/1988 | Munoz | |
| 4,730,463 | A | 3/1988 | Stanfill | |
| 4,958,747 | A | 9/1990 | Sheets | |
| 5,540,355 | A | 7/1996 | Hancock et al. | |
| 5,573,142 | A | 11/1996 | Morellato et al. | |
| 5,638,991 | A | 6/1997 | Todden et al. | |
| 5,833,096 | A | 11/1998 | Ohu | |

* cited by examiner

*Primary Examiner*—William C. Doerrler
*Assistant Examiner*—Melvin Cartagena
(74) *Attorney, Agent, or Firm*—Michael Best & Friedrich LLP

(57) ABSTRACT

The water dispenser of the present invention preferably has a draw tube mechanism for extending and retracting a draw tube with respect to a water bottle, a water pump for pumping water therefrom through the draw tube, and a dispensing outlet through which water is dispensed. The draw tube mechanism is preferably a rack and pinion set to which the draw tube is connected for moving the draw tube with respect to the water bottle. By preferably employing a substantially rigid draw tube (as opposed to conventional flexible draw tubes), the draw tube is consistently positioned to draw water from the bottom of the water bottle, thereby drawing all water from the water bottle and reducing waste. Some preferred embodiments provide for partial or full automation of the draw tube mechanism, such as by using one or more sensors to detect water bottle position, dispenser door closure, and the like.

53 Claims, 7 Drawing Sheets

COMESTIBLE FLUID DISPENSER APPARATUS AND METHOD

FIELD OF THE INVENTION

The present invention relates to fluid dispensers, and more particularly to comestible fluid dispensers and dispensing methods in which comestible fluid is supplied to the dispenser from bottles or other comestible fluid containers releasably connected to the dispenser.

BACKGROUND OF THE INVENTION

Fluid dispensers designed for dispensing fluid from relatively large bottles are familiar devices in multiple industries. Although the present invention is relevant to and can be used in many of such industries, the following description is directed toward the dispense of comestible fluid (and more particularly, toward the dispense of drinking water) by way of example only.

A very common type of comestible fluid dispenser is a water dispenser designed to hold a relatively large bottle in an inverted position. An example of such a dispenser is the bottled drinking water dispenser commonly found in office or work environments, normally used for providing a number of people with a supply of drinking water. Anyone who has placed a drinking water bottle into a dispenser of this type knows the shortcomings of this dispenser. Due to the bottle's weight, the process of lifting, inverting, and placing the bottle in the dispenser is difficult at best, and can be messy and even dangerous. Therefore, other types of drinking water dispensers are often preferred.

To address the problems related to the inverted bottle water dispenser just described, some bottled water dispensers are designed to dispense water from a bottle that is not inverted. These dispensers normally employ some type of draw tube that is inserted into the bottle and that is connected to a pump for pumping water from the bottle to a dispensing tap, nozzle, outlet, and the like. Water bottles can be significantly easier to load in such dispensers. However, the draw tube, pump, and associated equipment can make dispenser setup and preparation for dispensing more difficult. For example, the draw tube is typically manually inserted in the bottle, the bottle is often connected to the dispenser, and the pump must often be primed before dispensing can take place.

Still other types of bottled water dispensers are designed with an emphasis on mechanized and automated setup and preparation for dispensing. In U.S. Pat. No. 5,833,096 issued to Ohu for example, a user operates a switch to rotate a pulley about which a flexible absorption tube is wound. By rotating the pulley, the flexible absorption tube is unwound and is lowered into the water bottle. A pumping device connected to the flexible absorption tube pumps water from the water bottle through the flexible absorption tube. Rotation of the pulley in an opposite direction by user operation of the switch winds the flexible absorption tube about the pulley and therefore withdraws the flexible absorption tube from the water bottle.

Although mechanized and automated devices such as the Ohu device eliminate much of the work of a user in water dispenser setup and preparation, these devices also have their shortcomings. An important feature of any water dispensing system is to avoid water waste by completely draining the water bottles connected thereto. Particularly in cases where the draw tube is flexible and may not be reliably and consistently positioned at the lowest point in the water bottle to draw all fluid therefrom, some draw tubes may not be well-suited to perform this operation. Also, to reliably and consistently position the draw tube in this manner, the device or mechanism employed to move the draw tube between its extended and retracted positions should be fully controllable. In addition, and for purposes of safety and appearance, this device or mechanism and the draw tube is preferably substantially or fully enclosed within the dispenser. For these same reasons, the dispenser most preferably presents no moving parts accessible to a user from outside of the dispenser (without the opening of a normally-closed housing, door, or other dispenser structure).

Despite the improvements in water dispenser designs over the past several decades, conventional water dispensers are still not fully automated, and require some degree of user control to complete dispenser setup and preparation for dispensing. A water dispenser fully operable by merely loading a water bottle in the dispenser (whether by being loaded in a housing or otherwise) and permitting bottle changeout with minimal user action has not existed prior to the present invention.

In light of the problems and limitations of the prior art described above, a need exists for a comestible fluid dispenser that permits quick and easy container loading and unloading, requires little to no user setup and in some embodiments requires no user setup at all after container loading, reliably and consistently locates a draw tube in the container to ensure full removal of its fluid contents, employs a draw tube extension and retraction mechanism that is fully controlled, and includes structure that substantially encloses such a mechanism. Each preferred embodiment of the present invention achieves one or more of these results.

SUMMARY OF THE INVENTION

The comestible fluid dispenser of the present invention preferably has a draw tube mechanism for extending and retracting a draw tube with respect to a bottle, a comestible fluid pump for pumping comestible fluid from the bottle through the draw tube, and a dispensing outlet through which comestible fluid is dispensed. The draw tube mechanism can comprise a wide variety of devices, but most preferably is a rack and pinion set to which the draw tube is connected. Movement of the rack and pinion set generates movement of the draw tube with respect to the bottle. By preferably employing a substantially rigid draw tube as opposed to the flexible draw tubes of the prior art, the draw tube is consistently positioned to draw comestible fluid from the bottom of the bottle, thereby drawing substantially all comestible fluid from the bottle and reducing waste.

In some highly preferred embodiments, an arm is connected at one end to the rack and pinion set and at another end to the draw tube. More preferably, the arm connects the rack to a collar coupled to an end of the draw tube. Therefore, as the rack moves by rotation of the pinion, the draw tube connected thereto moves with the rack. This manner of draw tube connection and movement provides for repeatable and reliable location of the draw tube end with respect to the bottle (and more specifically, with respect to the bottom of the bottle).

Preferably, the rack and pinion set or other reciprocable device is driven by a motor which can be stopped and started by triggering one or more sensors detecting the position of the rack, draw tube, or other element of the draw tube mechanism. These sensors preferably transmit one or more signals to stop the motor when the rack (or other element of the draw tube mechanism) has completed its movement to a retracted or extended position. The rack and pinion set preferably provides substantially linear movement of the draw tube mechanism into and out of the bottle. Of course, other actuators and actuation mechanisms can be employed to drive the draw tube into and out of the bottle with the desired substantially linear movement. Such devices can be used instead of or in addition to a motor and a rack and pinion set, and include without limitation pneumatic or hydraulic actuators, motorized track or rail assemblies having shuttles, lugs, carriages, arms, or other elements movable therealong in any conventional manner, magnetic rail assemblies, and the like.

Comestible fluid is preferably pumped from the draw tube through a flexible fluid line by a pump. The flexible fluid line permits movement of the draw tube relative to the pump. The dispenser of the present invention also preferably has a reservoir in which comestible fluid can be held after being pumped from the bottle but before being dispensed from a dispensing outlet. The reservoir is preferably cooled with a heat exchanger and fan to cool comestible fluid prior to dispense. Comestible fluid is preferably pumped from the reservoir to the dispensing outlet through a fluid line and dispensing pump.

In some highly preferred embodiments, comestible fluid is pumped by the pump from the bottle to the reservoir for cooling and can also be pumped through another fluid line directly to the dispenser outlet for the dispense of comestible fluid at room temperature. For this purpose, a controllable valve can be connected to the output of the pump to direct comestible fluid to the dispensing outlet or to the reservoir.

Some preferred embodiments of the present invention provide for partial or full automation of the draw tube mechanism. Specifically, the motor driving the draw tube mechanism can be actuated directly by one or more sensors or controls or indirectly by a dispenser controller. For example, one or more sensors can be connected to a door of the dispenser housing to detect when the door is opened and/or closed and to automatically actuate the motor to move the draw tube to its extended or retracted position. Preferably, closure of the door automatically causes extension of the draw tube in preparation for comestible fluid pumping therethrough, while opening of the door automatically causes retraction of the draw tube to permit removal of the bottle. In other embodiments, one or more sensors can be positioned to detect the presence or lack of a bottle in the housing and to respond by automatically causing extension or retraction of the draw tube, respectively (upon closure of the housing door or otherwise). In other embodiments, one or more sensors detect whether the bottle is in position to receive the draw tube by detecting the position of a rack or other structure upon which the bottle rests. Still other embodiments of the present invention employ one or more user-manipulatable controls for user activation of the motor in order to extend and/or retract the draw tube upon user command.

Although any or all of the elements of the comestible fluid dispenser can be substantially or filly exposed, the comestible fluid dispenser more preferably has a housing that at least partially encloses (and more preferably fully encloses) the draw tube mechanism, pumps, reservoir, heat exchanger, fan, and fluid lines of the comestible fluid dispenser. Enclosing the comestible fluid dispenser elements in this manner not only presents a much more attractive appearance for the comestible fluid dispenser, but also shields users from moving parts such as the draw tube mechanism.

Some preferred embodiments of the present invention therefore provide an apparatus and method for dispensing comestible fluid with one or more of the following advantages: dispenser setup is significantly simplified and in some cases is not required at all, a draw tube mechanism can be employed to insert and retract the draw tube with respect to a bottle, the draw tube is controlled for consistent and repeated extension to a desired low position in the bottle to enable substantially complete dispense of the bottle's contents, and dispenser operations can be partially or fully automated. More information and a better understanding of the present invention can be achieved by reference to the following drawings and detailed description.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE PREFERRED EMBODIMENTS

Figure 1:
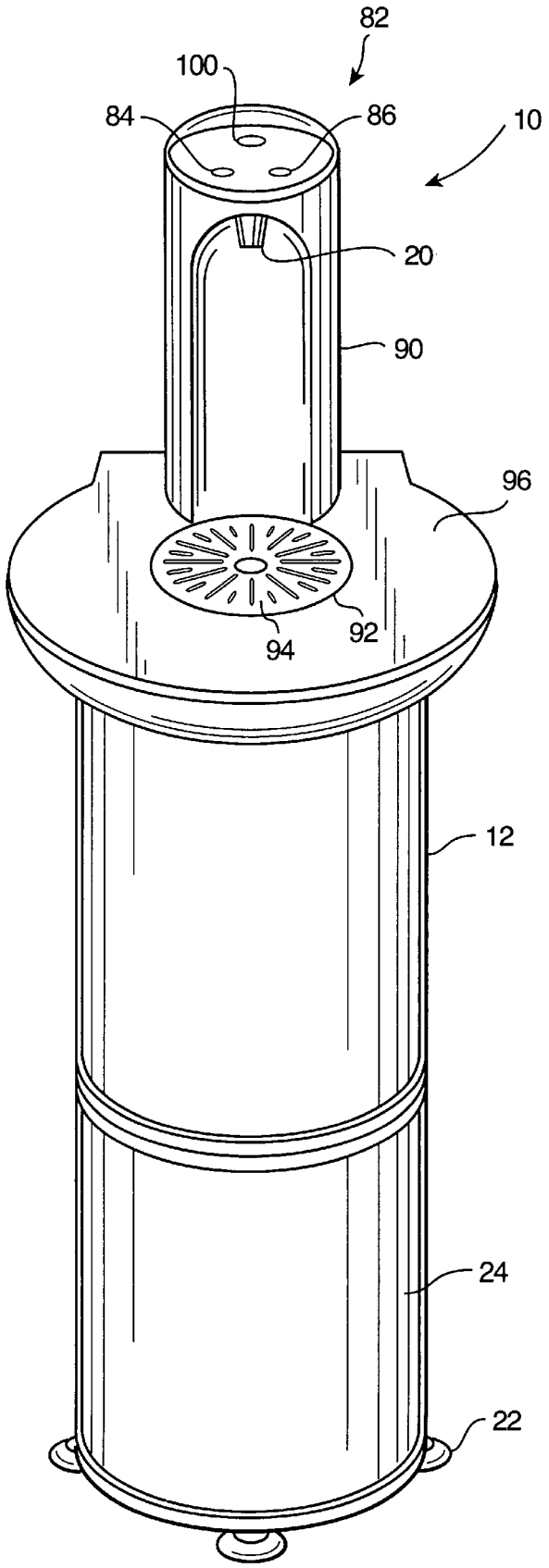
FIG. 1 is a perspective view of a fluid dispenser according to a preferred embodiment of the present invention.
Figure 2:
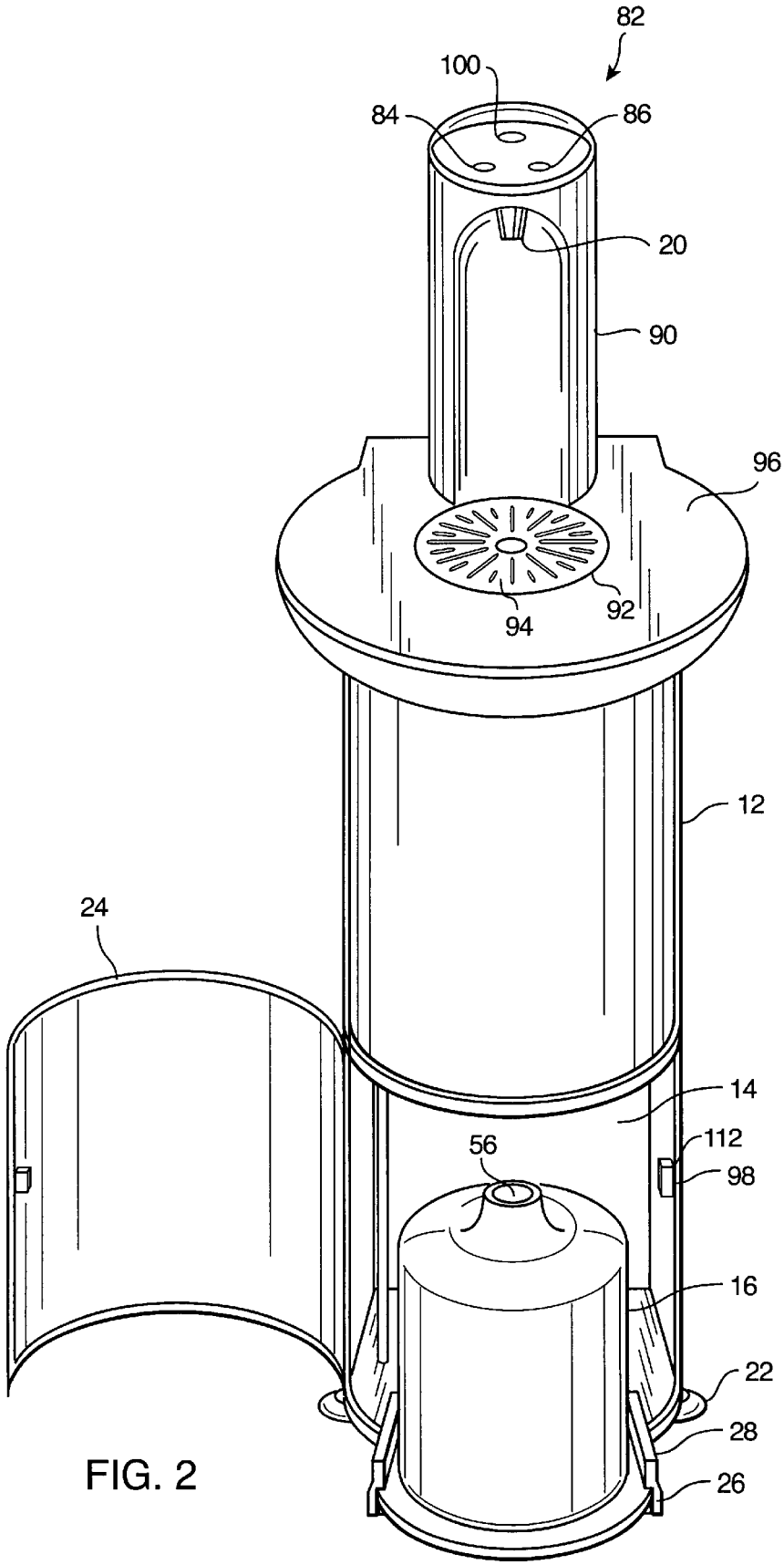
FIG. 2 is a perspective view of the fluid dispenser illustrated in FIG. 1, shown with the dispenser door open and the dispenser rack extended.

With reference first to the preferred embodiment of the present invention illustrated in FIGS. 1 and 2, a water dispenser 10 is shown which preferably has a housing 12, an interior space 14 for receiving a water bottle 16 (or fluid container having any other shape or form), a draw tube 18 for drawing water from the water bottle 16, and a dispensing outlet 20 through which water is dispensed upon user demand. As mentioned above, although the following description is with reference to a dispenser 10 for dispensing water from a water bottle 16, the present invention can be used for dispensing any comestible fluid. By way of example only, other comestible fluids that can be dispensed include sports drinks, tea, lemonade, fruit drinks, carbonated or non-carbonated beverages, alcoholic or non-alcoholic beverages, condiments, and the like whether served hot, cold, or at room temperature. Use of the present invention for dispensing water is therefore described herein only for purposes of illustration.

Figure 8:
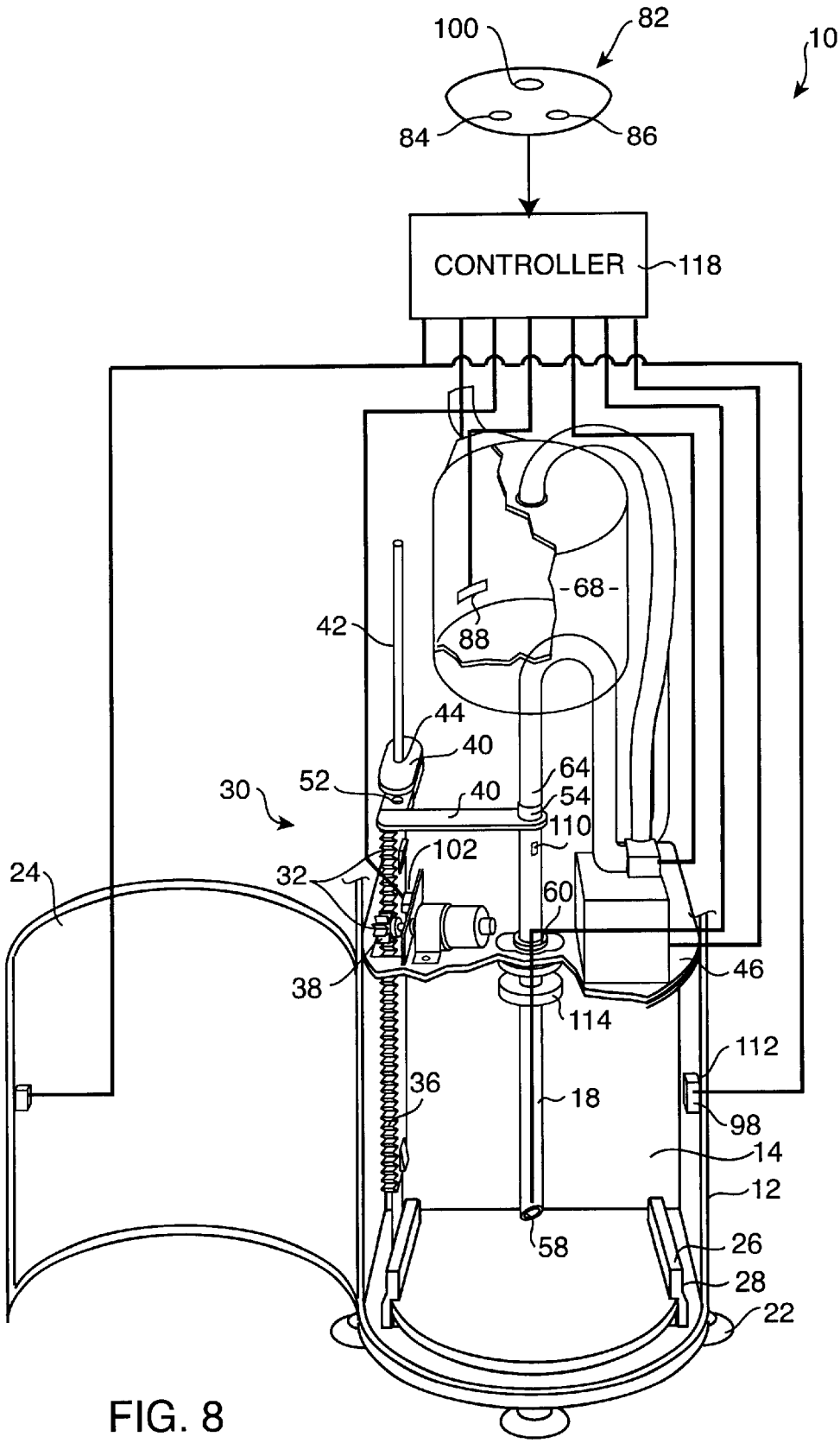
FIG. 8 is a schematic view of the fluid dispenser controls illustrated in FIGS. 1–7.

The housing 12 can take virtually any shape desired, such as the relatively elongated vertical structure shown in the figures. In this regard, the housing 12 can simply be a frame to which the various elements of the fluid dispenser 10 are mounted. However, the housing 12 is preferably an enclosure such as that shown in FIGS. 1 and 2. The housing 12 can have a plurality of legs or feet 22 attached thereto or integral therewith for resting the fluid dispenser 10 upon an elevated surface or upon the ground as desired. In some preferred embodiments, the housing 12 includes a door 24 openable to gain access into the interior space 14. The door 12 can be a sliding door, a folding door, and the like, but most preferably is a hinged door as shown in FIGS. 1, 2, and 8.

Water bottles can be placed directly within the interior space 14 in preparation for dispensing water therefrom. However, some preferred embodiments of the present invention employ a carriage 26 that can be slid to and from the interior space 14 to permit easier bottle loading and unloading. The carriage 26 can be mounted to move with respect to the housing 12 in any number of manners well known to those skilled in the art. Preferably, the carriage 26 is mounted upon drawer slides which are themselves connected to the housing 12 in any conventional manner. To properly align a water bottle 16 on the carriage 26 and to help prevent bottle movement relative thereto, the carriage 26 can have a lip, raised portion, or walls 28 located adjacent to and/or surrounding the water bottle 16 as best shown in FIGS. 2–4 and 8.

The dispenser 10 preferably employs a draw tube mechanism 30 which operates to move the draw tube 18 with respect to a water bottle 16 loaded in the fluid dispenser 10. Some highly preferred embodiments of the draw tube mechanism 30 employ a rack and pinion set 32 connected to the draw tube 18 and driven by a motor 34. The rack and pinion set 32 includes a rack 36 which meshes with a pinion 38 to provide relative motion between the rack 36 and pinion 38 in a manner well known to those skilled in the art. Although the rack 36 is an elongated element preferably having gear teeth capable of meshing with gear teeth on the pinion 38, the rack 36 can take a number of different conventional forms such as an elongated element having a series of apertures in which spokes or legs of the pinion 38 mesh, a chain meshing with fingers or pins on a sprocket, and the like. Any elongated element cooperating with a rotating element to generate relative movement therebetween in a manner such as a conventional rack and pinion is considered to fall within the spirit and scope of the present invention.

Preferably, movement of the draw tube 18 is substantially linear for improved control over draw tube location in the water bottle 16 when the draw tube 18 is extended therein. Other embodiments of the present invention employ different mechanisms and elements for generating such linear movement of the draw tube 18. For example, the draw tube mechanism 30 can have one or more hydraulic or pneumatic actuators which can be actuated to move the draw tube 18 directly or indirectly connected thereto. Such actuators can be mounted within the housing 12 and can be actuated in any conventional manner. As another example, the draw tube mechanism 30 can have a conventional magnetic rail with a slide, carriage, or other element movable therealong in a conventional manner to move the connected draw tube 18 as described above. One having ordinary skill in the art will appreciate that still other linear actuator elements and mechanisms exist for moving the draw tube 18 through a range of substantially linear positions into and out of the water bottle 16 as will be described in greater detail below. These alternative linear actuator elements and mechanisms fall within the spirit and scope of the present invention.

A rack and pinion set 32 (or other linear actuator element or mechanism movable as just described) provides excellent control over the position of the draw tube 18 connected thereto, and stands in contrast to other devices less capable of full control over the draw tube 18. For example, a draw tube wound about a pulley can become bound during unwinding and can permit undesirable floating or drifting of the draw tube as it is being lowered into the water bottle.

The motor 34 is preferably drivably connected to the pinion 38 in any conventional manner, such as by being keyed or setscrewed thereto, by a press or interference fit, by a coupling, and the like. The motor 34 and the pinion 38 are preferably mounted to the housing 12 and do not move with respect thereto. In such cases, the rack 36 is preferably mounted to move with respect to the pinion 38, motor 34, and housing 12, and more preferably to translate within the housing 12 as the pinion 38 rotates to drive the rack 36. To this end, the rack 36 can be supported for such movement in a number of different manners. In the illustrated preferred embodiment for example, the rack 36 is connected to one or more bosses 40 which slide upon a rail 42 mounted to the housing 12. The bosses 40 can be connected to the rack 36 in any conventional manner (e.g., by threaded fasteners, rivets, glue, welding, brazing, and the like) or can be integral therewith. The rail 42 can also be connected to the housing 12 in any such manner. The rail 42 can have any cross-sectional shape to mate preferably with similarly-shaped apertures in the bosses 40. However, the rail 42 preferably has a round cross-sectional shape upon which bosses 40 having round apertures 44 are slidably received.

The rack 36 of the rack and pinion set 32 is preferably slidable along the rail 42 as just described, thereby providing controlled motion of the rack 36 when moved by the pinion 38. It should be noted that this manner of controlling rack motion is only presented by way of example, and that many other elements and structures can be employed to perform this same function, each of which would be recognized by one skilled in the art. By way of example only, the rack 36 can be coupled to or be integral with a drawer slide mounted to the housing 12, can have a rail slidably received within a mating rail mounted to the housing 12, can have fingers or posts slidably received within a track mounted to the housing 12, can be telescopingly received upon a pole, guide, rail, or other elongated element mounted to the housing 12, and the like. In all such cases, the rack 36 is at least partially guided and controlled so that the draw tube 18 connected thereto moves in a predictable and controlled manner. Still other manners of guiding and controlling rack movement are possible and fall within the spirit and scope of the present invention.

The motor 34 is preferably mounted upon the housing 12. Although the motor 34 can be mounted upon any portion of the housing 12 (preferably limited only by the ability of the pinion 38 to still mesh with the rack 36 as described above), the motor 34 is preferably mounted upon a housing partition 46 dividing the housing 12 into the interior space 14 described above and another interior space 48 in which is preferably located the draw tube mechanism 30 and other components of the fluid dispenser 10 to be described in greater detail below. The housing partition 46 preferably serves to define separate enclosed interior spaces 14, 48 of the housing 12, to provide guiding structure for the draw tube 18 in its movement within the fluid dispenser 10, and to provide a structure upon which internal components of the fluid dispenser 10 can be mounted if desired. Therefore, the housing partition 46 is preferably a wall defined by a plate or sheet of any resilient material such as metal, plastic, fiberglass, composites, and the like. However, especially where separate enclosed interior spaces 14, 48 are not desired or needed in other embodiments, the housing partition 46 can instead be a frame defined by one or more beams, struts, or other elements providing structural support for the motor 34 and a guiding structure for the draw tube 18. In the illustrated preferred embodiment, the housing partition 46 is a wall of sheet metal welded to side walls of the housing 12.

Figure 5:
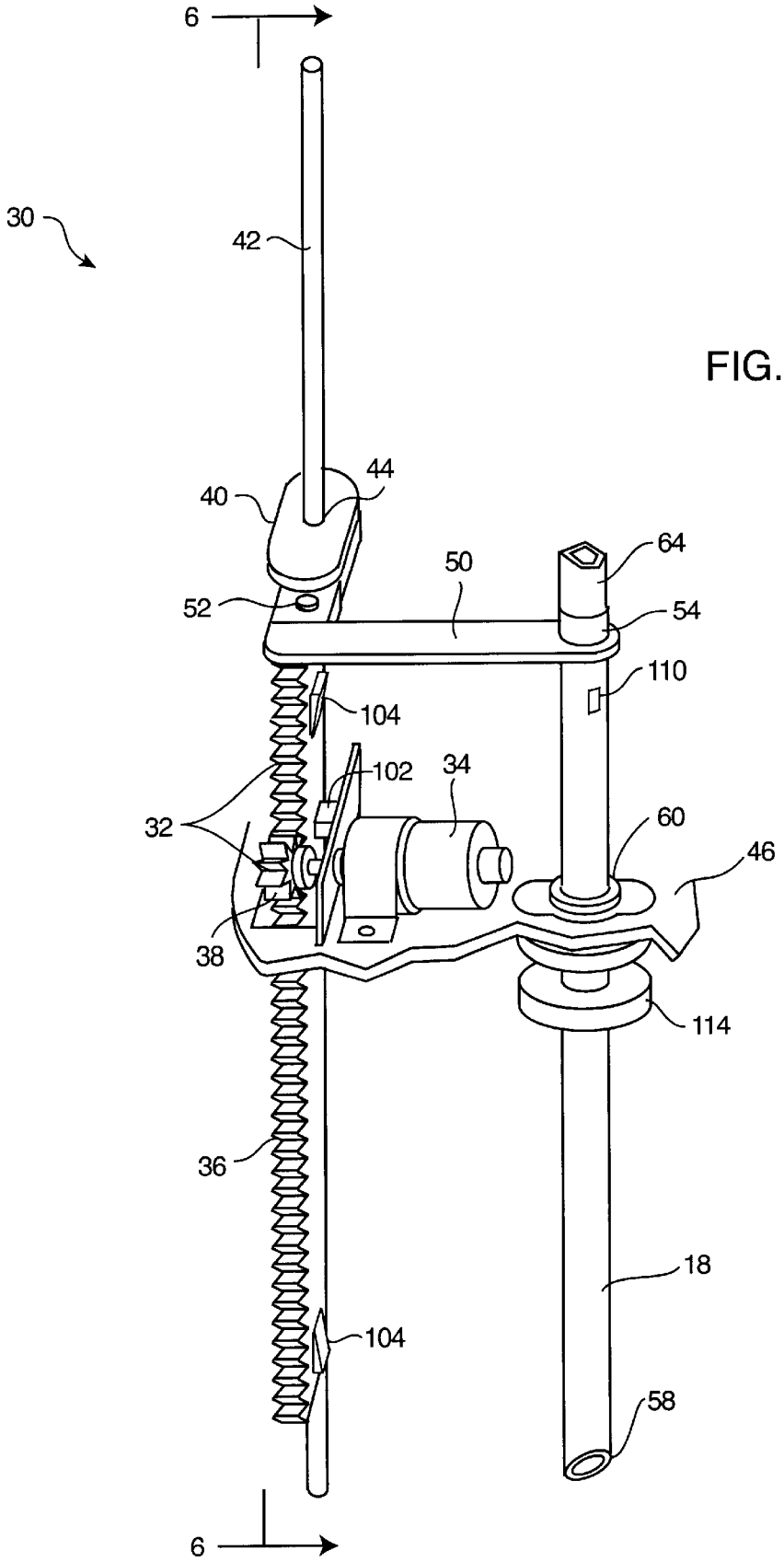
FIG. 5 is a detail perspective view of the draw tube mechanism of the fluid dispenser illustrated in FIGS. 3 and 4.

The rack 36 of the rack and pinion set 32 is connected to the draw tube 18 so that movement of the rack 36 results in corresponding movement of the draw tube 18. To this end, the rack 36 and the draw tube 18 can be connected in a number of different manners, but most preferably are connected by an arm 50 extending from the rack 36 to the draw tube 18. The arm 50 can take any shape capable of connecting the rack 36 and draw tube 18 in this manner and for this purpose, but preferably is an elongated member extending from near a side wall of the housing 12 to the draw tube 18 in the interior space 48 of the housing 12. The arm 50 is preferably connected to the rack 36 by one or more threaded fasteners 52, and is preferably connected to the draw tube 18 by a collar 54 as best shown in FIG. 5. In alternative embodiments, the arm 50 can be integral with the rack 36 and/or the collar 54, or can be connected to the rack 36 and/or collar 54 in any conventional manner (including the manners of connection described above with reference to the connection between the bosses 40 and the rack 36). Also, although the arm 50 is preferably connected to the draw tube 18 by the collar 54, this connection can be made in a number of other manners, such as by a hose clamp or other type of clamp, by being glued thereto, by conventional fasteners connecting the arm to a flange, standoff, boss, or other element on the draw tube 18, and the like.

The draw tube 18 is preferably elongated and rigid or substantially rigid, and is sufficiently long to extend through an opening or spout 56 of the water bottle 16 and to the bottom of the water bottle 16 when the draw tube 18 is extended as described in more detail below. The stiffness of the draw tube 18 provides a significant amount of control over the location of the end 58 of the draw tube 18 in the water bottle 16 when the draw tube 18 is extended. In contrast to hoses and other flexible tubing commonly used in conventional dispensers, the elongated and rigid draw tube 18 can therefore be reliably located at a low point of the water bottle 16 to enable dispense of all fluid from the water bottle 16.

To better control movement of the draw tube 18 in the dispenser 10, the housing 12 is preferably provided with a guide aperture 60 through which the draw tube 18 is received. In the illustrated preferred embodiment, the guide aperture 60 is located in the housing partition 46. However, the guide aperture 60 can instead be defined by a collar, ring, lug, or tube secured with respect to the housing 12 (and more preferably secured to the housing 12). To this end, the collar, ring, lug, tube, or other element in which the guide aperture 60 is defined can be secured in position with respect to the housing 12 in any conventional manner. For example, such an element can be mounted in the housing 12 over the interior space 14 by an arm, frame, wall, or other element extending from a side wall of the housing 12. The guide aperture 60 is preferably shaped similar to the draw tube 18 with a clearance fit therebetween. However, the guide aperture 60 preferably at least partially stabilizes the draw tube 18 and limits lateral movement of the draw tube 18 in the housing 12.

Figure 3:
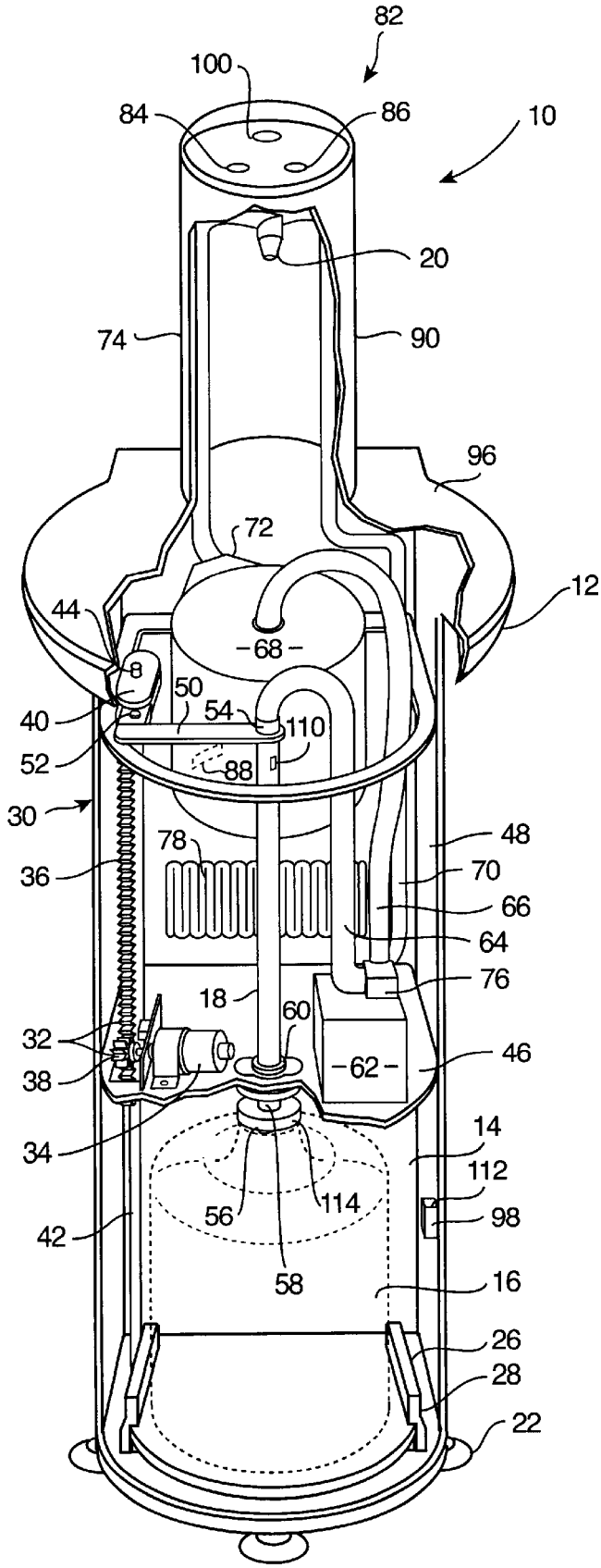
FIG. 3 is a perspective view of the fluid dispenser illustrated in FIGS. 1 and 2, partially sectioned to show internal components of the fluid dispenser and shown with the fluid draw tube in a retracted position.
Figure 4:
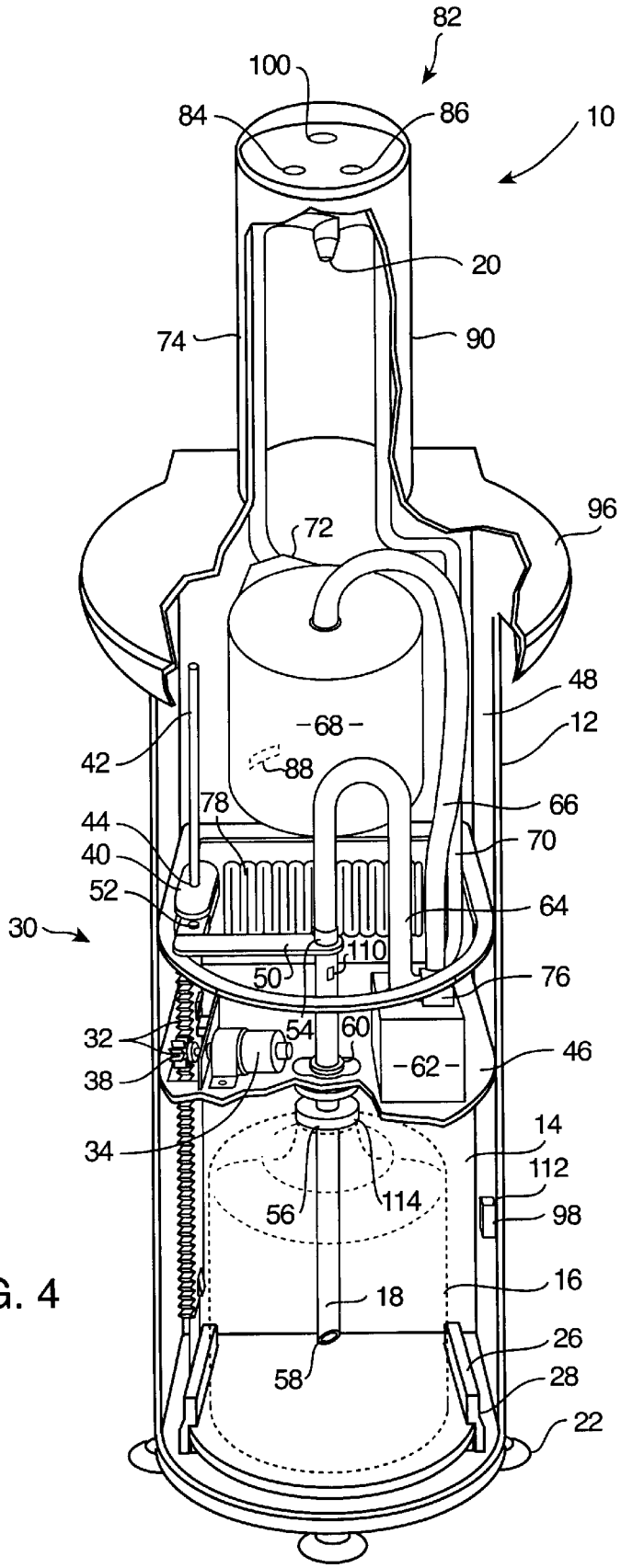
FIG. 4 is a perspective view of the fluid dispenser illustrated in FIG. 3, shown with the fluid draw tube in an extended position.

The water dispenser 10 preferably also includes a water pump 62 for pumping water from the water bottle 16 through the draw tube 18. The water pump 62 can be of any conventional type, and is preferably electrically powered. The water pump 62 is preferably connected to the draw tube 18 by a flexible fluid line 64 as best shown in FIGS. 3 and 4. The flexible fluid line 64 is connected to the draw tube 18 and to the inlet of the water pump 62 in a conventional manner, such as by a press fit, by hose clamps, by threaded connectors at the ends of the flexible fluid line 64, and the like.

In some highly preferred embodiments such as the illustrated preferred embodiment, the output of the water pump 62 is connected to two fluid lines: one fluid line 66 running to a reservoir 68 where water is stored (and if desired, can be cooled or heated) prior to its dispense and another fluid line 70 running to the dispensing outlet 20. Water in such embodiments is preferably pumped from the reservoir 68 through a fluid line 74 to the dispensing outlet 20 by a dispensing pump 72.

Where two fluid output lines run from the water pump 62 as just described, a conventional valve 76 is preferably connected to the output of the water pump 62 and to the two fluid lines 66, 70. The valve 76 can preferably be controlled to direct water pumped by the water pump 62 to either one of the two fluid lines 66, 70. Therefore, pumped water 62 can be directed to the reservoir 68 or to the dispensing outlet 20 by control of the valve 76.

With continued reference to FIGS. 3 and 4, the two fluid lines 66, 70 are preferably made of flexible tubing and are connected to the valve outputs and to the dispensing outlet 20 and reservoir 68 in any conventional manner such as those described above with reference to the flexible fluid line 64 connected to the water pump 62. In this regard, the valve 76, dispensing outlet 20 and reservoir 68 can have connection shunts or nipples (not shown) for connection to the fluid lines 66, 70. In other embodiments, the two fluid lines 66, 70 are pipes or tubes made of metal, plastic, or other relatively inflexible material.

The reservoir 68 can be located anywhere in the water dispenser 10, but in some preferred embodiments is located above the water bottle 16. In the illustrated preferred embodiment for example, the reservoir 68 is located in the upper interior space 48 above the water bottle 16. The reservoir 68 is preferably insulated in any conventional manner, such as by being surrounded by insulation material, being defined by a thermous, and the like. However, the reservoir 68 can instead be nothing more than a vessel in which water is temporarily held prior to its dispense. The reservoir 68 can take any shape or size desired, but is preferably a fraction of the capacity of the water bottle 16 (to help save energy especially in those embodiments where the reservoir 68 is cooled as will now be described).

The reservoir 68 and the water therein is preferably cooled by a heat exchanger 78 and an associated fan (not shown). The heat exchanger 78 is preferably a conventional electrically-powered refrigeration unit with a compressor, condenser, evaporator, and expansion valve or capillary tube (also not shown), but can instead be any other type of refrigeration device or system. The fan directs cooled air around and past the reservoir 68, although cooling systems not employing a fan 80 can be used if desired, such as a tube heat exchanger coiled around the reservoir 68. In other embodiments, no cooling device or system is employed to cool the reservoir 68 or water therein.

Like the water pump 62 connected between the draw tube 18 and the reservoir 68, the dispenser pump 72 connected between the reservoir 68 and the dispensing outlet 20 can be of any conventional type, and is preferably electrically powered. The fluid line 74 connected to the dispensing pump 72 and passing fluid from the reservoir 68 to the dispensing outlet 20 is preferably flexible tubing, but can made of rigid tubing or pipes as described above with reference to the fluid lines 66, 70 running from the valve 76.

Some highly preferred embodiments of the water dispenser 10 have user-manipulatable controls 82 for dispensing water from the dispensing outlet 20. With reference to FIGS. 1–4 and 8 for example, two buttons 84, 86 cause room temperature water and cooled water to be dispensed, respectively. Specifically, the buttons 84, 86 are preferably connected to the water pump 62 and to the dispensing pump 72, respectively, either directly or more preferably via a conventional controller 118 (see FIG. 8).

Therefore, when the room temperature water pump button 84 is depressed by a user, the water pump 62 is preferably activated to pump water through valve 76 and to the dispensing outlet 20. Room temperature water is therefore preferably pumped directly from the water bottle 16, through draw tube 18, fluid line 64, water pump 62, valve 76, fluid line 70, and out of dispensing outlet 20. Most preferably, the valve 76 is also controlled to direct water from the water pump 62 to the fluid line 70 running to the dispensing outlet 20 rather than to the reservoir 68. In this regard, the valve 76 is preferably a conventional electrically controlled fluid valve responding to electrical control signals directly from the pump button 84 or (more preferably) to electrical control signals from the controller 118 connected to the pump button 84. When the cooled water button 86 is depressed by a user, the dispensing pump 72 is preferably activated to pump water from the reservoir 68, through fluid line 74, and out of dispensing outlet 20. Both the water pump 62 and the dispensing pump 72 are preferably connected to the buttons 82, 84 via the controller 118, but can instead be directly connected to the buttons 82, 84 for activation thereby if desired.

The user-manipulatable controls 82 are preferably buttons of any type, but are most preferably membrane switch buttons to present a pleasing appearance and for ease of cleaning. Other types of controls 82 can be used instead, including without limitation one or more levers, push plates, touch-sensitive keys, switches triggered by proximity sensors (such switches being well known to those skilled in the art), pedals, and the like. Depending upon the type of control employed, one control can be used to dispense water from either of the two fluid lines 70, 74. By way of example only, a three-position lever can be used in which the lever can be pivoted in one direction to dispense water from the reservoir 68 and in an opposite direction to dispense water directly from the water bottle 16. Still other types of conventional controls operating to dispense multiple fluids can be used and fall within the spirit and scope of the present invention.

The user-manipulatable controls 82 of the water dispenser 10 are preferably located at the top of the water dispenser 10 for easy access by the user. In other embodiments, these controls 82 can be located on a front wall of the housing 12, a side wall of the housing 12, or even at the bottom of the housing 12 (for example, in the case of a pedal-type control).

Although the water dispenser 10 of the illustrated preferred embodiment is capable of water dispense from the reservoir 68 or directly from the water bottle 16, other embodiments of the present invention only provide for water dispense from the reservoir 68. In such embodiments, no fluid line connects the water pump 62 directly to the dispenser outlet 20 as does the fluid line 70 in the illustrated preferred embodiment. Also in such embodiments, the multi-outlet valve 76 need not necessarily be employed, and the fluid line 66 can connect the reservoir 68 directly to the water pump 62.

Other embodiments of the present invention do not have a reservoir 68 for holding water prior to dispense. Such water dispensers 10 may still employ a heat exchanger 78 and/or a fan positioned to cool the water bottle 16 (such as by being located in the housing 12 adjacent to the water bottle 16 or being positioned to permit cooling air to be directed to the water bottle 16). However, where no reservoir 68 is used in the water dispenser 10, some embodiments also do not have a heat exchanger 78 or fan. In either case, the water pump 62 preferably pumps water directly to the dispensing outlet 20 by a fluid line connected to the water pump 62 and to the dispensing outlet 20, and the fluid lines 66, 74, dispensing pump 72, and multi-outlet valve 76 of the illustrated preferred embodiment can be eliminated.

Preferably, the water dispenser 10 has only one dispensing outlet 20, whether connected to multiple fluid lines (e.g., fluid line 74 running from the reservoir 68 and fluid line 70 running from the water pump 62) or to only one fluid line. Where the dispensing outlet 20 is connected to multiple fluid lines, this connection can be made in any conventional manner, such as by a T or Y fluid line connector, by multiple connection inlets of the dispensing outlet 20, and the like.

In other preferred embodiments, the water dispenser 10 has more than one dispensing outlet 20 each supplied by one or more fluid lines connected thereto. For example, the illustrated preferred embodiment can instead have one dispensing outlet 20 connected to fluid line 70 supplying room temperature water directly from the water bottle 16 and another dispensing outlet 20 connected to fluid line 74 supplying cooled water from the reservoir 68.

Another preferred embodiment of the present invention supplies room temperature water from the reservoir 68 rather than directly from the water bottle 16. Specifically, the reservoir 68 has a first fluid line connected at a top portion thereof and a second fluid line connected at a bottom portion thereof. Because cooler water tends to sink toward the bottom of the reservoir 68 and warmer water tends to rise toward the top, the first fluid line draws warmer water from the reservoir 68 than the second fluid line. In this type of reservoir and fluid line arrangement, only the bottom of the reservoir 68 is cooled to permit water at the top of the reservoir 68 to remain near room temperature. In those embodiments of the present invention having more than one fluid line running from the reservoir 68 to the dispensing outlet(s), each fluid line can have its own dedicated dispensing pump activated by a user-manipulated control or controller (as described above) and supplying water to one or more dispensing outlets 20 through one or more fluid lines running thereto. More preferably however, the fluid lines run to the same dispensing pump 72 and are connected thereto by a conventional multi-inlet valve, conventional Y-type, T-type, or other type of fluid line connectors, or by multiple inlets of the dispensing pump 72. One fluid line then preferably runs from the dispensing pump 72 to the dispensing outlet 20 as described above with reference to the illustrated preferred embodiment.

In those embodiments of the present invention having a reservoir 68, water is preferably supplied to the reservoir 68 by the water pump 62 to keep the reservoir 68 at least partially filled. Especially where the reservoir 68 is cooled, this insures that a supply of cooled water is on hand for immediate dispense at any time. To this end, the reservoir 68 preferably has a conventional water level sensor 88 for detecting when the water level in the reservoir 68 has dropped to a predetermined low level. The sensor 88 can be a fluid sensor connected to the inside of the reservoir 68, a float-type fluid level sensor mounted within the reservoir 68, an optical sensor in the reservoir, and the like. Any conventional fluid level sensing device can be used to detect the water level in the reservoir 68. Like the fluid level sensing devices just mentioned, each such device functions and can be connected to the reservoir 68 in a conventional manner and will not therefore be described in greater detail herein.

The water level sensor 88 preferably transmits (or causes to be transmitted) one or more electrical signals directly to the water pump 62 or to the water pump 62 via the water dispenser controller (if used) to activate the water pump 62. The water pump 62 can be deactivated in a number of different well known manners. For example, the above-described water level sensor 88 or a second water level sensor can detect when a desired water level is reached in the reservoir 68. As another example, the water pump 62 can be deactivated after a set amount of time. In yet another embodiment, a flow sensor can be connected to the water pump 62, the fluid line 66, or to the reservoir 68 to detect the amount of fluid entering the reservoir 68 and to deactivate the water pump 62 after a desired amount of fluid flow has been detected. These and still other manners of deactivating the water pump 62 after reservoir replenishment are possible, are conventional in nature and operation, and fall within the spirit and scope of the present invention.

As mentioned above, the water dispenser 10 can take any shape and size desired. In this regard, the dispensing outlet (s) can be located anywhere on the fluid dispenser 10, such as at the top of the fluid dispenser 10, on a side wall of the housing 12, or in a recess in the housing 12. In some highly preferred embodiments such as that shown in the figures, the dispensing outlet 20 is located at the top of a tower 90 on top of the fluid dispenser 10. Preferably, the dispensing outlet 20 is oriented to direct water downwardly, although any other dispensing outlet orientation can be used as desired, such as a laterally-directed dispensing outlet or an upwardly-directed dispensing outlet 20 for producing an arc of water similar to that produced by a conventional drinking fountain.

In some preferred embodiments, the water dispenser 10 can have a surface upon which a container can rest during water dispense. With reference to the illustrated preferred embodiment for example, the water dispenser 10 has a platform 96 located below the dispensing outlet 20. In addition, the water dispenser 10 preferably has a drip receptacle 92 located to catch and receive stray drips, spray, and splashes of water. The drip receptacle 92 is preferably shaped to support a container placed thereon, although some embodiments of the present invention do not have a supporting surface for a container and only employ the drip receptacle 92 to catch stray water. The drip receptacle 92 preferably has a grill, apertured plate, frame, or other fluid-transmitting cover 94 thereover. The drip receptacle 92 and the cover 94 can take any shape desired, such as the round shape shown in the figures.

Another optional feature of the present invention permits a user to open the door 24 of the housing 12 by manipulating a user-controllable element such as a button 100, lever, switch, and the like. Specifically, the door 24 can be held closed by one or more powered latches 98. The latches 98 can take a number of different conventional forms, such as solenoid-driven latches, motor-driven latches, electromagnet sets (one magnet on the door 24 and another on the housing 12 or door frame), and the like. Such latch types and their operation are well known to those skilled in the art and are not therefore described further herein.

Preferably, the door latch 98 is electrically connected to the door button 100 for actuation thereby. The door latch 98 can be connected directly to the door button 100, but more preferably is connected to the door button 100 via the dispenser controller 118. The door button 100 is preferably located with the controls 82, although the door button 100 can be in any other location on the water dispenser 10 as desired. To generate door opening upon release of the door latch 98, the door 24 can be biased partially or fully to an open position by a spring, hydraulic cylinder, actuator, or other biasing mechanism (not shown) connected to the door 24 and to the housing 12 in any conventional manner.

In operation, a new (e.g., full) water bottle 16 is readied for dispensing by the water dispenser 10 by first preferably placing the bottle 16 in the housing 12. In those embodiments employing a housing door 24, the door 24 is first opened either manually or in conjunction with pressing the door button 100 to release the door latch 98 as described above. The draw tube 18 is preferably retracted upon opening of the door 24. Specifically, a sensor 112 mounted to detect the opening of the door 24 preferably transmits one or more signals either directly to the motor 34 or more preferably to the motor 34 via the dispenser controller 118. The sensor 112 is preferably a conventional magnetic sensor on the housing 12 adjacent to the door 24 and capable of detecting the loss of contact with a magnet on the door 24 (or vice versa). Other sensor types for sensor 112 can instead be used and are well known to those skilled in the art, including without limitation motion sensors, proximity sensors, mechanical trip switch sensors, and the like, any of which can be employed in a conventional manner to detect the opening and/or closing of the housing door 24. The signal(s) preferably activate the motor 34 to turn the pinion 38 and to draw the rack 36 upward, carrying the draw tube 18 therewith by the connection of the arm 50 between the rack 36 and the draw tube 18.

Figure 6:
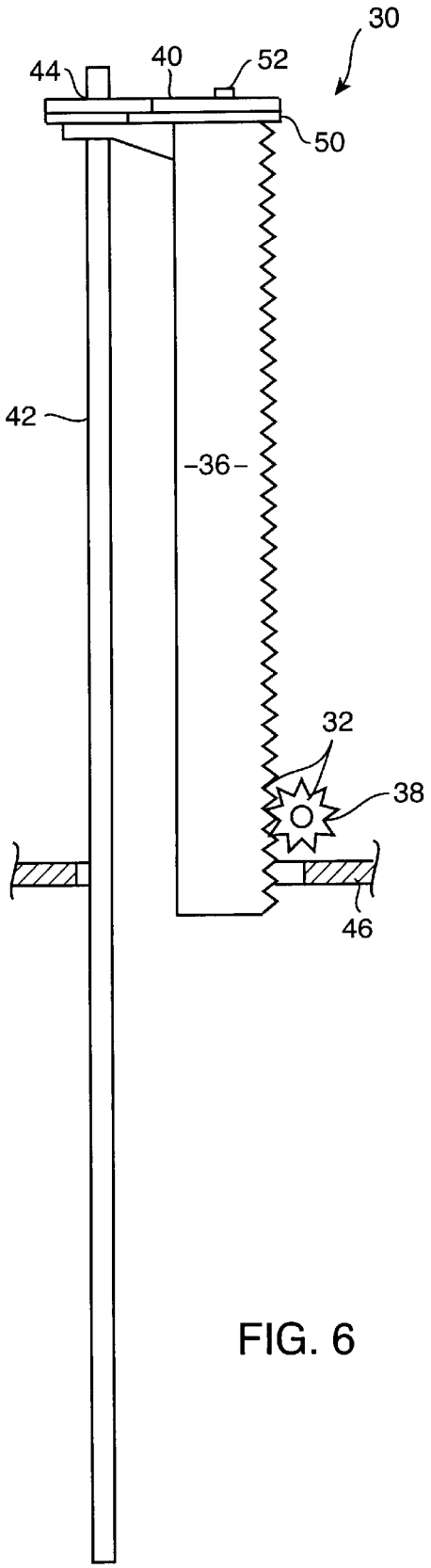
FIG. 6 is a side view of the draw tube mechanism illustrated in FIG. 4, shown in a retracted position.

When the draw tube 18 has been moved to its retracted position such as that shown in FIGS. 3 and 6, the motor 34 can be stopped in a number of different manners. Preferably, a sensor 102 is located on the rack 36 or adjacent to the rack 36 and detects the rack's position when the rack 36 has reached a desired retracted position. The sensor 102 thereby detects the draw tube's position when the draw tube 18 has reached a desired retracted position. The sensor 102 can be coupled directly to the motor 34 to send a signal thereto for deactivating the motor 34 at this point, but more preferably is connected to the motor 34 via the dispenser controller 118 which performs this operation. The sensor 102 is most preferably a microswitch sensor which is mechanically tripped (e.g., by contacting a protrusion such as a ramp, pin, wall, abutment, and the like) when the rack 36 has reached a desired position. In the illustrated preferred embodiment for example, the sensor 102 is mounted adjacent to the rack 36 and is tripped by a raised portion 104 on the rack 36 when the rack 36 has moved to a desired retracted position. Conversely, such a sensor 102 could be mounted upon the rack 36 to be tripped by an adjacent stationary element or structure of the water dispenser 10. By way of example only, the sensor 102 in other embodiments can be a proximity sensor, a magnetic sensor on the rack 36 or housing 12 for detecting the proximity of a magnet on the housing 12 or rack 36, respectively, or a motion sensor. As with the preferred mechanically-tripped sensor 102 described above, these alternative sensors are conventional in nature and operation and are not therefore described further herein. Still other types of conventional sensors 102 for detecting the position of the rack 36 in its retracted state are possible and fall within the spirit and scope of the present invention.

After the water bottle 16 has been loaded within the water dispenser 10, the motor 34 is preferably activated to turn the pinion 38 and to move the rack 36, thereby moving the connected draw tube 18 toward an extended position within the water bottle 16. The motor 34 is preferably activated at this stage by closure of the housing door 24, thereby tripping the door sensor 112 which transmits a motor activation signal directly to the motor 34 or indirectly by the dispenser controller 118. Alternatively, such a signal can be produced by another door sensor of any type described above with reference to the first door sensor 112 and operating in any manner also described with reference thereto.

Figure 7:
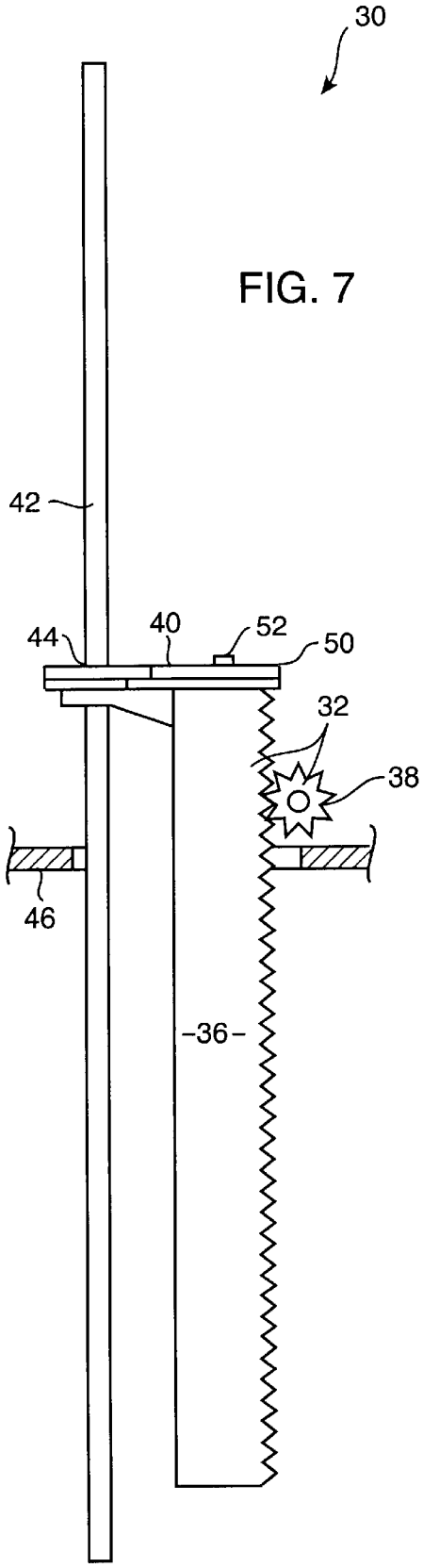
FIG. 7 is a side view of the draw tube mechanism illustrated in FIG. 4, shown in an extended position.

When the draw tube 18 has been moved to its extended position as shown in FIGS. 4 and 7, the motor 34 can be stopped again in any of the manners described above with reference to stopping the motor 34 in its retracted position. Preferably, the same sensor 102 described above is tripped by another raised portion 104 on the rack 36 when the rack 36 has reached a desired extended position. This sensor 102 thereby detects the draw tube's position when the draw tube 18 has reached a desired extended position. As an alternative to using one sensor 102 tripped in two different positions of the rack 36 and draw tube 18, two sensors can be employed for stopping the motor 34 (one for each position of the rack 36 and draw tube 18). The two sensors can be located and can operate in any of the manners described above and can be any of the sensor types described above with reference to sensor 102.

It will be appreciated by one having ordinary skill in the art that the sensor(s) 102 used to trigger deactivation of the motor 34 need not necessarily be located on or adjacent to the rack 36 for detecting rack position. Instead, the sensor(s) 102 can be positioned to detect the location of other draw tube mechanism elements, such as the arm 50 or the draw tube 18 itself. By way of example only, one or more sensors 102 can be mounted on the draw tube 18 or near the guide aperture 60 to detect the position of the draw tube 18 in the guide aperture 60. As another example, trip switches can be mounted above and below the arm 50 to be contacted thereby when the arm 50 (and therefore, the draw tube 18) has been lifted or lowered sufficiently. Still other manners of detecting draw tube position by employing sensors are possible, would be recognized by one having ordinary skill in the art, and fall within the spirit and scope of the present invention.

The motor 34 can be deactivated in still other conventional manners, some of which do not employ sensors as described above. For example, the motor 34 can be controlled to deactivate after a set period of time known to be sufficient to fully extend or retract the draw tube 18 (e.g., by the dispenser controller connected thereto, by a timer connected to the motor in a conventional manner, etc.). Alternatively, the motor 34 can be deactivated by detection of motor overload. Specifically, a conventional motor controller can be connected to the motor 34 to detect when a significant increase in resistance is experienced by the motor 34. This increase can correspond to the end of available travel of the rack 36 abutting against the housing 12 or a stop mounted thereon, to the draw tube 18 contacting the bottom of the water bottle 16 or housing 12 if no water bottle 16 is present, and the like. When the motor controller detects this overload, the motor controller preferably deactivates the motor 34. If desired, a conventional clutch can be connected between the motor 34 and pinion 38 to prevent damage to the motor when overloaded as just described. One having ordinary skill in the art will appreciate that other manners exist for deactivating the motor 34 when the draw tube mechanism 30 reaches its inserted and retracted positions.

After the draw tube 18 has been inserted within the water bottle 16 and has reached an extended position such as that shown in FIGS. 4 and 7, the motor 34 is preferably deactivated as just described, and water can be dispensed from the water bottle 16 through the draw tube 18. In some preferred embodiments of the present invention, the water dispenser provides an indication to the user when a new water bottle is needed and/or when water in the fluid dispenser 10 is running low. Preferably, a fluid sensor 110 is connected to the water pump 62 or to the flexible fluid line 64 between the draw tube 18 and the water pump 62, and can therefore detect when no water is being drawn from the draw tube 18. As shown in the figures, the fluid sensor 110 can instead be connected to the draw tube 18 itself for this same purpose. In either case, when the fluid sensor 110 detects no water being drawn by the water pump 62, the fluid sensor 110 preferably transmits one or more signals to activate a connected alarm and/or a light or display (not shown), thereby alerting the user to the low-water condition in the water dispenser 10. The alarm and/or light or display can be connected directly to the fluid sensor 110, but more preferably is connected thereto by the dispenser controller in a conventional manner.

It should be noted that other manners exist for detecting a low-water condition in the water dispenser 10, each one of which is within the present invention. By way of example only, the fluid sensor 110 can be located in the reservoir 68 to detect a low-water condition therein. Such a fluid sensor 110 can be of any type as described above with reference to the water level sensor 88 in the reservoir 68. As another example, an optical sensor can be used to detect when water is no longer present in any desired location between the draw tube 18 and the dispensing outlet 20 or to detect the water level through a transparent wall of the water bottle 16. Alternatively, a conventional weight sensor can be used to detect when the water bottle 16 reaches a weight corresponding to the weight of an empty water bottle 16. Still other manners of detecting a low-water state in the water dispenser 10 would be recognized by one having ordinary skill in the art.

To replace the water bottle 16 in the water dispenser 10, the user preferably opens the housing door 24 again, thereby preferably automatically triggering retraction of the draw tube mechanism 30 as described in greater detail above.

As also described above, the motor 34 is preferably directly or indirectly activated by one or more signals to move the draw tube mechanism 30 between its extended and retracted positions. These signals can be transmitted by one or more door sensors 112 positioned to detect when the housing door 24 has been opened or closed. It should be noted that other manners exist for triggering activation of the motor 34. For example, one or more sensors can be positioned in the housing 12 to detect when the carriage 26 upon which the water bottle 16 rests is moved to its place within the housing 12. In such cases, when such a sensor detects that the carriage 26 has been moved out of its place in the housing 12, the sensor preferably triggers activation of the motor 34 to retract the draw tube mechanism 30 in much the same way as the door sensor 112 described above. Also in such cases, when the sensor detects that the carriage 26 has been moved back into its place in the housing 12, the sensor preferably triggers activation of the motor 34 to extend the draw tube mechanism 30. This sensor can any of a number of different types, including without limitation a mechanical trip sensor, magnetic sensor, proximity sensor, motion sensor, and the like positioned to detect when the carriage 26 has been returned to its place within the housing 12. In other embodiments of the present invention, this sensor can instead or in addition be positioned to detect the presence (or lack thereof) of a bottle on the carriage 26 in position within the housing 12, in which case the motor 34 is preferably not activated by the sensor to extend the draw tube mechanism 30 unless the sensor detects the bottle 16 received within the housing 12.

In other embodiments of the present invention, the motor 34 can receive an activation signal from one or more user-actuatable controls taking any conventional form, such as one or more buttons, levers, switches, pedals, and the like. This control can be located anywhere on the water dispenser 10, but most preferably is located with the other water dispenser controls 82. Also, this control can be connected directly to the motor 34 for activation thereof or more preferably to the dispenser controller 118 which responds to actuation of the control by activating the motor 34.

As noted above, some embodiments of the present invention employ a housing 12 having no door 24. Other embodiments do not employ any structure (such as the water bottle carriage 26) which can be monitored to detect when the water bottle 16 is in proper position in the housing 12 for insertion of the draw tube 18. Automatic activation of the motor 34 as described above is still possible in these and the above-described embodiments by a number of other conventional detection devices, including without limitation optical sensors positioned to detect any portion of the water bottle 16 when properly positioned to receive the draw tube 18, pressure sensors to detect when the water bottle 16 is properly positioned, mechanical trip sensors tripped by the water bottle 16 when fully received in the housing 12, and the like. Still other conventional detection devices can be used and fall within the spirit and scope of the present invention.

In some preferred embodiments, the draw tube 18 has a cap 114 thereon for at least partially covering the opening 56 of the water bottle 16. This cap 114 helps to prevent dust and other contaminants from entering the water bottle 16. The cap 114 is preferably slidably received upon the draw tube 18 with a clearance fit, and therefore can move along the draw tube 18. As the draw tube 18 is inserted in the water bottle 16, the cap 114 preferably slides along the draw tube 18 until insertion of the draw tube 18 in the water bottle 16 is complete. When the draw tube 18 is retracted from the water bottle 16, the cap 114 preferably either remains resting upon the water bottle opening 116 or stops against the housing partition 46 and then slides along the draw tube 18 until retraction of the draw tube 18 from the water bottle 16 is complete.

One or more stops (not shown) on the draw tube 18 can prevent movement of the cap 114 past desired points on the draw tube 18. For example, a first stop can be located near the tip of the draw tube 18 to keep the cap 114 on the draw tube 18, and a second stop can be located near the top of the draw tube 18 to prevent the cap 114 from riding up against the collar 54. The stops can take any form capable of limiting cap movement, such as ribs, lips, flanges, bumps, or other types of protrusions on the draw tube 18. In other embodiments, the cap 114 can be fixed with respect to the draw tube 18 in any conventional manner and can move therewith toward and away from the water bottle opening 56. The cap 114 in such embodiments is preferably free to move without obstruction from other elements and structure of the water dispenser 10. In the illustrated preferred embodiment for example, the guide aperture 60 is preferably large enough to permit the cap 114 and the draw tube 18 to move therethrough.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims. For example, although the reservoir 68 in the illustrated preferred embodiment is cooled, the reservoir 68 can instead be heated for the dispense of hot or warm water from the water dispenser 10. In other embodiments, separate fluid lines 66 can run from the water pump 62 via one or more valves 76 to multiple reservoirs 68 maintaining water at different temperatures. For example, one reservoir could be heated for the dispense of hot water while another reservoir could be cooled for the dispense of cold water.

As mentioned above, the housing 12 can take any shape desired. In addition, the housing 12 can partially or fully enclose any portion or all of the draw tube mechanism 30, reservoir 68, heat exchanger 78, fan 80, pumps 62, 72, and fluid lines 64, 66, 70, 74. In some embodiments, any or all of these water dispenser elements can instead be partially or fully exposed as desired. However, in most highly preferred embodiments, all of these elements are preferably filly enclosed in the housing 12. A fully enclosed water dispenser 10 not only protects the components of the water dispenser 10, but also protects users from contacting moving parts (e.g., the rack and pinion set 32, the arm 50, fluid line 64, and the like) of the water dispenser 10. In this regard it should be noted that the rack 36 and pinion 38 is therefore movable with respect to the housing 12. Preferably therefore, the rack and pinion set 32 is movable within and with respect to the housing 12 but remains enclosed within the housing 12 in its range of movement.

It should be noted that throughout the appended claims, when one element is said to be "coupled" to another, this does not necessarily mean that one element is fastened, secured, or otherwise attached to another element. Instead, the term "coupled" means that one element is either connected directly or indirectly to another element or is in mechanical or electrical communication with another element. Examples include directly securing one element to another (e.g., via welding, bolting, gluing, frictionally engaging, mating, etc.), elements which can act upon one another (e.g., via camming, pushing, or other interaction), one element imparting motion directly or through one or more other elements to another element, and one element electrically connected to another element either directly or through a third element.

As used herein and in the appended claims, the term "fluid line" or "water line" refers to any conduit or passage through which fluid or water is transported, and unless otherwise stated is independent of the length, diameter, material, flexibility or inflexibility, shape, or other properties. Examples of fluid or water lines include tubing, hose, cavities in solid bodies, pipe, and the like made of plastic, nylon, PVC, copper, steel, aluminum, or other material.

We claim:

1. A fluid dispenser for dispensing fluid from a fluid container having an opening, the fluid dispenser comprising:

a draw tube removably insertable into the fluid container;

a rack and pinion coupled to the draw tube, the draw tube movable by the rack and pinion into and out of the fluid container;

a motor drivably coupled to the pinion;

a pump coupled to and in fluid communication with the draw tube to draw fluid from the fluid container;

a reservoir in fluid communication with the pump and receiving fluid pumped by the pump; and a fluid dispensing outlet coupled to and in fluid communication with the reservoir.

2. The fluid dispenser as claimed in claim 1, wherein the draw tube is substantially rigid.

3. The fluid dispenser as claimed in claim 1, further comprising an arm coupled at one end to the rack and pinion and coupled at an opposite end to the draw tube.

4. The fluid dispenser as claimed in claim 1, herein the draw tube and pump are coupled by a flexible fluid line permitting relative movement between the draw tube and the pump.

5. The fluid dispenser as claimed in claim 1, wherein the pump and reservoir are coupled by a flexible fluid line permitting relative movement between the pump and the reservoir.

6. The fluid dispenser as claimed in claim 1, wherein the reservoir is cooled.

7. The fluid dispenser as claimed in claim 1, further comprising a position sensor coupled to the motor and mounted to detect a position of the draw tube, the position sensor responsive to detection of the draw tube position by sending at least one signal to deactivate the motor.

8. The fluid dispenser as claimed in claim 7, wherein:

the draw tube has an extended position in which the draw tube is inserted in the fluid container and a retracted position in which the draw tube is withdrawn from the fluid container, and the detected position of the draw tube is one of the extended and retracted positions of the draw tube.

9. The fluid dispenser as claimed in claim 1, further comprising:

a door movable to at least partially enclose the fluid container in the fluid dispenser; and a sensor coupled to the motor and positioned to be tripped by the door.

10. The fluid dispenser as claimed in claim 1, further comprising a user-manipulatable control coupled to the motor, the control manipulatable to activate the motor and to thereby move the draw tube.

11. The fluid dispenser as claimed in claim 10, wherein activation of the motor by the user-manipulatable control generates movement of the draw tube into the fluid container.

12. The fluid dispenser as claimed in claim 10, wherein activation of the motor by the user-manipulatable control generates movement of the draw tube out of the fluid container.

13. The fluid dispenser as claimed in claim 1, further comprising a cap coupled to the draw tube, the cap movable by the draw tube to removably cover the opening of the fluid container.

14. The fluid dispenser as claimed in claim 1, further comprising a carriage movable with respect to the draw tube and upon which the fluid container can be placed.

15. The fluid dispenser as claimed in claim 1, further comprising:

a fluid sensor positioned to detect a low fluid level in the fluid dispenser; and a low fluid level indicator coupled to the fluid sensor.

16. The fluid dispenser as claimed in claim 1, further comprising:

a first fluid line coupled between the pump and the reservoir; and a second fluid line coupled to the pump and through which fluid can be dispensed directly from the fluid container.

17. A fluid dispenser for dispensing fluid from a fluid container having a container opening, the fluid dispenser comprising:

a housing having an interior area, and a door for access to the interior area;

a draw tube in the housing;

a fluid pump coupled to the draw tube;

a rack and pinion set in the housing, the rack and pinion set coupled to the housing and to the draw tube; and a motor coupled to the rack and pinion set, the motor drivable to move the draw tube independently of and with respect to the housing between a position inserted within the fluid container and a position withdrawn from the fluid container.

18. The fluid dispenser as claimed in claim 17, wherein the draw tube and the rack and pinion set are substantially fully enclosed within the housing.

19. The fluid dispenser as claimed in claim 17, further comprising a sensor coupled to the motor and triggered by door closure, the motor actuatable by the sensor to move the draw tube toward the position inserted within the fluid container.

20. The fluid dispenser as claimed in claim 17, further comprising a sensor coupled to the motor and triggered by opening of the door, the motor actuatable by the sensor to move the draw tube toward the position withdrawn from the fluid container.

21. The fluid dispenser as claimed in claim 17, further comprising a sensor coupled to the motor and mounted to detect a position of the rack and pinion set corresponding to the position of the draw tube inserted within the fluid container.

22. The fluid dispenser as claimed in claim 17, further comprising a sensor coupled to the motor and mounted to detect a position of the rack and pinion set corresponding to the position of the draw tube withdrawn from the fluid container.

23. The fluid dispenser as claimed in claim 17, further comprising a control coupled to the motor, wherein the control is user-manipulatable to activate the motor and to move the draw tube toward the position inserted within the fluid container.

24. The fluid dispenser as claimed in claim 17, further comprising a control coupled to the motor, wherein the control is user-manipulatable to activate the motor and to move the draw tube toward the position withdrawn from the fluid container.

25. The fluid dispenser as claimed in claim 17, wherein the draw tube is coupled to and in fluid communication with the pump by a flexible fluid line.

26. The fluid dispenser as claimed in claim 17, further comprising an arm coupled at one end to the rack and pinion set, extending from the housing into the interior area thereof, and coupled at an opposite end to the draw tube.

27. The fluid dispenser as claimed in claim 17, further comprising a reservoir in fluid communication with the pump and receiving fluid pumped from the fluid container by the pump.

28. The fluid dispenser as claimed in claim 27, wherein the reservoir is cooled.

29. The fluid dispenser as claimed in claim 17, further comprising a cap coupled to the draw tube, the cap movable to removably cover the container opening.

30. The fluid dispenser as claimed in claim 17, wherein the draw tube is substantially rigid.

31. A method of dispensing fluid from a fluid container, comprising:

providing a motor coupled to a rack and pinion set;

providing a fluid pump in fluid communication with a draw tube coupled to the rack and pinion set;

driving the rack and pinion set with the motor to insert the draw tube into the fluid container:

pumping fluid from the fluid container through the draw tube with the pump;

storing fluid pumped from the fluid container in a reservoir in fluid communication with the pump;

pumping fluid from the reservoir to a dispensing outlet in fluid communication with the reservoir; and dispensing fluid from the dispensing outlet.

32. The method as claimed in claim 31, further comprising cooling fluid within the reservoir.

33. The method as claimed in claim 31, further comprising dispensing fluid by the pump directly from the fluid container.

34. The method as claimed in claim 33, wherein:

the dispensing outlet is a first dispensing outlet; and fluid is dispenser directly from the fluid container through a second dispensing outlet.

35. The method as claimed in claim 31, wherein the draw tube is inserted into the fluid container through a container opening, the method further comprising covering the container opening with a cap coupled to the draw tube.

36. The method as claimed in claim 31, wherein the draw tube has an extended position in which the draw tube is inserted within the fluid container and a retracted position in which the draw tube is withdrawn from the fluid container, the method further comprising:

detecting at least one of the extended and retracted positions with a sensor coupled to the motor; and transmitting at least one signal from the sensor to the motor to stop the motor.

37. The method as claimed in claim 31, further comprising:

opening a door of the dispenser;

tripping a sensor by opening the door;

transmitting at least one signal from the sensor to the motor to activate the motor; and driving the rack and pinion set with the motor to withdraw the draw tube from the fluid container.

38. The method as claimed in claim 31, further comprising:

closing a door of the dispenser;

tripping a sensor by closing the door; and transmitting at least one signal from the sensor to the motor to activate the motor.

39. The method as claimed in claim 31, further comprising closing a door of the dispenser to substantially enclose the fluid container.

40. The method as claimed in claim 31, further comprising:

manipulating a control coupled to the motor to activate the motor; and driving the rack and pinion set with the motor to withdraw the draw tube from the fluid container.

41. The method as claimed in claim 31, further comprising driving the rack and pinion set with the motor to withdraw the draw tube from the fluid container.

42. The method as claimed in claim 31, further comprising maintaining the rack and pinion set and the draw tube substantially fully enclosed within the dispenser during the driving, pumping, storing, and dispensing steps.

43. A method of dispensing fluid from a fluid container, comprising:

placing a fluid container in a housing;

driving a rack and pinion set in the housing with a motor, the rack and pinion set coupled to the housing and to a draw tube in the housing;

moving the draw tube independently of the housing from a retracted position with respect to the fluid container to an extended position inside the fluid container by driving the rack and pinion set;

inserting the draw tube into the fluid container by driving the rack and pinion set;

pumping fluid from the fluid container through the draw tube; and dispensing pumped fluid from a dispenser outlet.

44. The method as claimed in claim 43, further comprising:

closing a door of the housing;

tripping a sensor with the door; and transmitting at least one signal from the sensor to the motor to drive the rack and pinion set.

45. The method as claimed in claim 43, further comprising closing a door of the housing to substantially enclose the fluid container.

46. The method as claimed in claim 43, wherein:

the pinion is coupled to the housing; and driving the rack and pinion set includes driving the pinion to move the rack with respect to the housing.

47. The method as claimed in claim 46, wherein the draw tube is coupled to the rack for movement with the rack.

48. The method as claimed in claim 43, wherein the rack and pinion set and the draw tube remain substantially enclosed in the housing during the driving, moving, inserting, pumping, and dispensing steps.

49. The method as claimed in claim 43, wherein the draw tube is inserted into the fluid container through an opening in the fluid container, the method further comprising capping the opening of the fluid container.

50. The method as claimed in claim 43, further comprising pumping fluid from the draw tube to a reservoir in fluid communication with the draw tube.

51. The method as claimed in claim 50, further comprising cooling fluid in the reservoir prior to dispensing the fluid from the dispenser outlet.

52. The method as claimed in claim 43, further comprising:

manipulating a user-manipulatable control;

transmitting at least one signal from the user-manipulatable control to the motor;

driving the rack and pinion set by the motor in response to the at least one signal; and moving the draw tube independently of the housing from the extended position to the retracted position by driving the rack and pinion set in response to the at least one signal.

53. The method as claimed in claim 52, wherein the housing includes a door, the method further comprising transmitting at least one signal from the user-manipulatable control to generate opening of door.

* * * * *